US007924256B2

(12) United States Patent
Jeon

(10) Patent No.: US 7,924,256 B2
(45) Date of Patent: Apr. 12, 2011

(54) DISPLAY DEVICE

(75) Inventor: Byung-Kil Jeon, Anyang-si (KR)

(73) Assignee: Samsung Electronics Co., Ltd. (KR)

( * ) Notice: Subject to any disclaimer, the term of this patent is extended or adjusted under 35 U.S.C. 154(b) by 1210 days.

(21) Appl. No.: 11/542,760

(22) Filed: Oct. 3, 2006

(65) Prior Publication Data

US 2007/0132701 A1 Jun. 14, 2007

(30) Foreign Application Priority Data

Dec. 12, 2005 (KR) ..... 10-2005-0121764

(51) Int. Cl.
*G09G 3/36* (2006.01)

(52) U.S. Cl. ..... 345/98; 345/100

(58) Field of Classification Search ..... 345/87, 345/89, 98–100, 204
See application file for complete search history.

(56) References Cited

U.S. PATENT DOCUMENTS

| | | | | |
|---|---|---|---|---|
| 6,229,513 | B1 * | 5/2001 | Nakano et al. | 345/99 |
| 6,323,836 | B1 * | 11/2001 | Shin | 345/99 |
| 7,280,093 | B1 * | 10/2007 | Hiroki | 345/100 |
| 7,336,253 | B2 * | 2/2008 | Kim | 345/98 |
| 2003/0142053 | A1 * | 7/2003 | Kumagai et al. | 345/87 |
| 2004/0189584 | A1 * | 9/2004 | Moon | 345/100 |
| 2005/0030275 | A1 | 2/2005 | Kwon | |

FOREIGN PATENT DOCUMENTS

| | | |
|---|---|---|
| CN | 1487493 | 4/2004 |
| CN | 1504988 | 6/2004 |
| CN | 1588509 | 3/2005 |
| WO | 03-107314 A2 | 12/2003 |

* cited by examiner

*Primary Examiner* — Regina Liang
(74) *Attorney, Agent, or Firm* — Innovation Counsel LLP

(57) ABSTRACT

A display device in which a plurality of pixels are disposed in a matrix form includes data lines connected with the pixels, a signal controller for processing image data received from the outside and generating a plurality of control signals and clock signals, a gray voltage generator for generating a plurality of gray voltages, and a data driver including a plurality of data driver ICs for selecting gray voltages corresponding to image data from signal controller among the gray voltages and applying them as data voltages to data lines, wherein data driver includes four data driver ICs groups and each data driver IC group receives a separate clock signal and includes at least two data driver ICs connected in series with each other is disclosed. Because data driver IC groups receive the separate clock signals a signal delay can be reduced, and because phases of the clock signals are different a harmonic component can be reduced compared with the related art in which the clock signals have no phase difference, and thus EMI can be reduced.

11 Claims, 5 Drawing Sheets

DISPLAY DEVICE

CROSS-REFERENCE TO RELATED APPLICATION

This application claims priority to and the benefit of Korean Patent Application No. 10-2005-0121764 filed in the Korean Intellectual Property Office on Dec. 12, 2005, the entire contents of which are incorporated herein by reference.

FIELD OF THE INVENTION

The present invention relates to flat panel display devices.

DESCRIPTION OF THE RELATED ART

Flat panel displays such as the organic electroluminescence display (OLED), the plasma display panel (PDP), and liquid crystal display (LCD) are being actively developed to replace the existing cathode ray tube (CRT) that is considered to be heavy and large.

The PDP displays characters or images using gas discharge plasma whereas the OLED uses electric field emission provided by certain organic materials or polymers. The LCD displays an image by applying an electric field to a liquid crystal layer interposed between two display panels to control the transmittance of light that passes through liquid crystal layer.

The LCD and the OLED include display panels on which pixels including switching elements and display signal lines are formed, a gate driver for turning the switching elements of the pixels on or off by sending gate signals to gate lines among the display signal lines, a gray voltage generator for generating a plurality of gray voltages, a data driver for selecting voltages corresponding to image data among the gray voltages as data voltages and applying the selected data voltages to data lines among the display signal lines, and a signal controller for controlling these elements.

In order to transfer data to data driver from signal controller, a voltage driving method or an (electric) current driving method may be employed. In the voltage driving method, data is transferred by determining a logical value by using a voltage with a voltage swing of about 2.5V. In the (electric) current driving method the transfer of data corresponding to a logical values corresponding to '0' and '1', the different levels of current are provided wherein the current corresponding to 'I' is ⅓ of the level of current corresponding to a '0'. In addition, a point-to-point cascading interface, which is a so-called wise bus, is used to help reduce power consumption.

The voltage driving method, which transmits high speed signals using TTL (Transistor Transistor Logic), produces a high level of EMI (Electromagnetic interference) which increases with the size of the display device. In addition, larger display devices which include a large number of circuit components tend to increasingly delay the transfer of signals from signal controller.

SUMMARY OF THE INVENTION

The present invention provides a display device having reduced EMI and signal delay. Briefly, in accordance with the principles of the invention, a display device includes a matrix of pixels for displaying images corresponding to data signals, comprises a clock generator for generating a plurality of clock signals having different phases; and a plurality of data drivers controlled by the clock signals for delivering the data signals to a respective group of the pixels for each of said phases. An exemplary embodiment of the present invention provides a display device in which a plurality of pixels are disposed in a matrix form, including: data lines connected with the pixels; a signal controller for processing image data received from outside and generating a plurality of control signals and clock signals; a gray voltage generator for generating a plurality of gray voltages; and a data driver including a plurality of data driver ICs for selecting gray voltages corresponding to image data from signal controller among the gray voltages and applying them as data voltages to data lines. Data driver includes at least four data driver ICs groups, and each data driver IC group receives a separate clock signal and includes at least two data driver ICs connected in series with each other.

Clock signals each with a different phase are input to at least four data IC groups, respectively. The phase difference between adjacent clock signals may be smaller than 30°, and the greatest phase difference between two clock signals may be smaller than 180°. Signal controller and data driver ICs can be connected in a point-to-point manner. Data driver IC groups can be positioned symmetrically, centering on signal controller. The plurality of clock signals may include first to sixth signals inputted to first to sixth data driver IC groups. The first to sixth signals may sequentially have a phase difference smaller than 30°, and the first and sixth signals may have a phase difference smaller than 180°.

The first to sixth data driver IC groups may apply the data voltages to data lines at the same time.

The first to third data driver IC groups may be positioned at the left side of signal controller, and the fourth to sixth data driver IC groups may be positioned at the right side of signal controller. Herein, signal controller and data driver ICs can be connected in a point-to-point manner.

BRIEF DESCRIPTION OF THE DRAWINGS

The accompanying drawings briefly described below illustrate exemplary embodiments of the present invention, and together with the description, serve to explain the principles of the present invention.

DETAILED DESCRIPTION OF THE EMBODIMENTS

Figure 1:
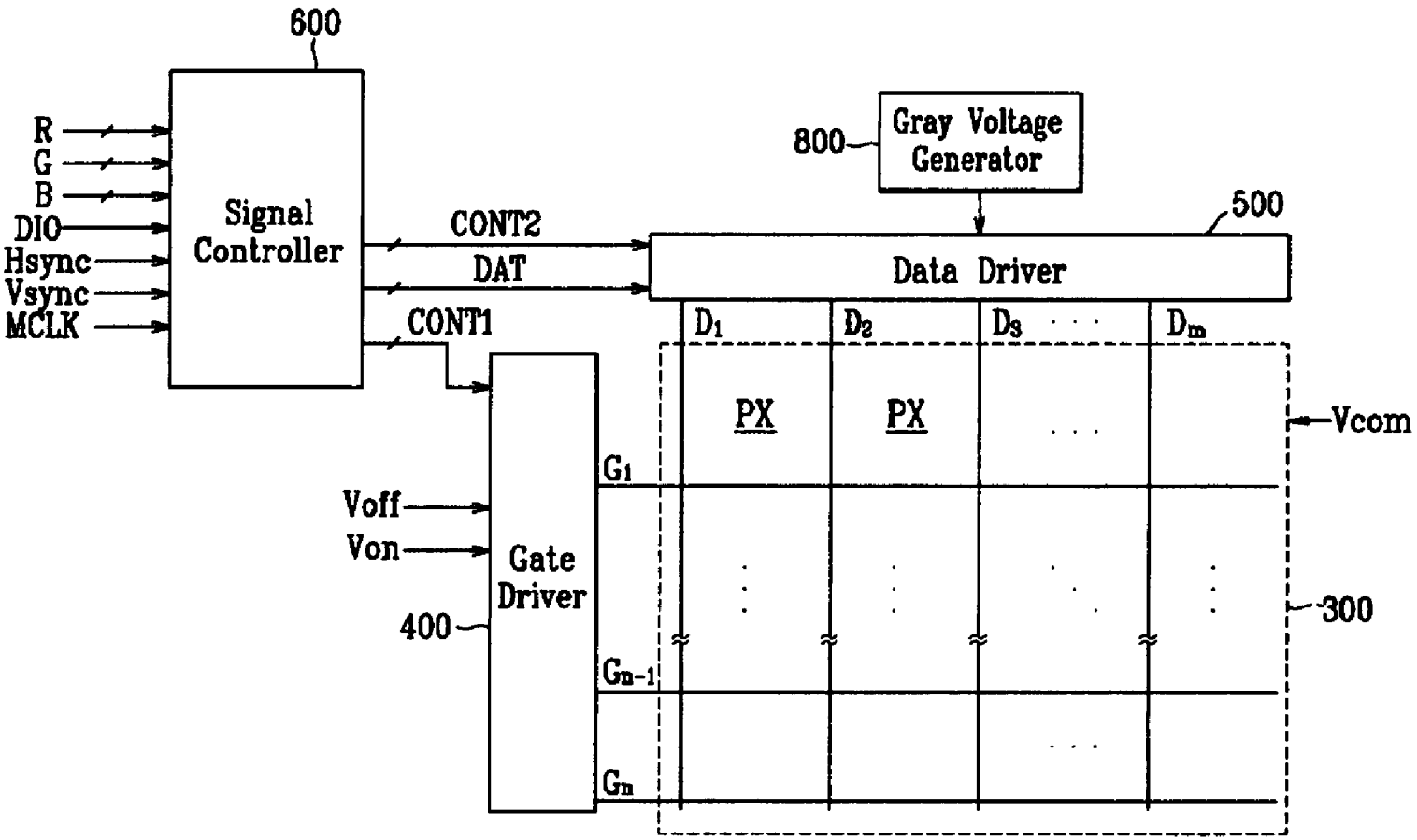
FIG. 1 is a schematic block diagram of a liquid crystal display (LCD) according an exemplary embodiment of the present invention.

The present invention will now be described more fully hereinafter with reference to the accompanying drawings, in which preferred embodiments of the invention are shown.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
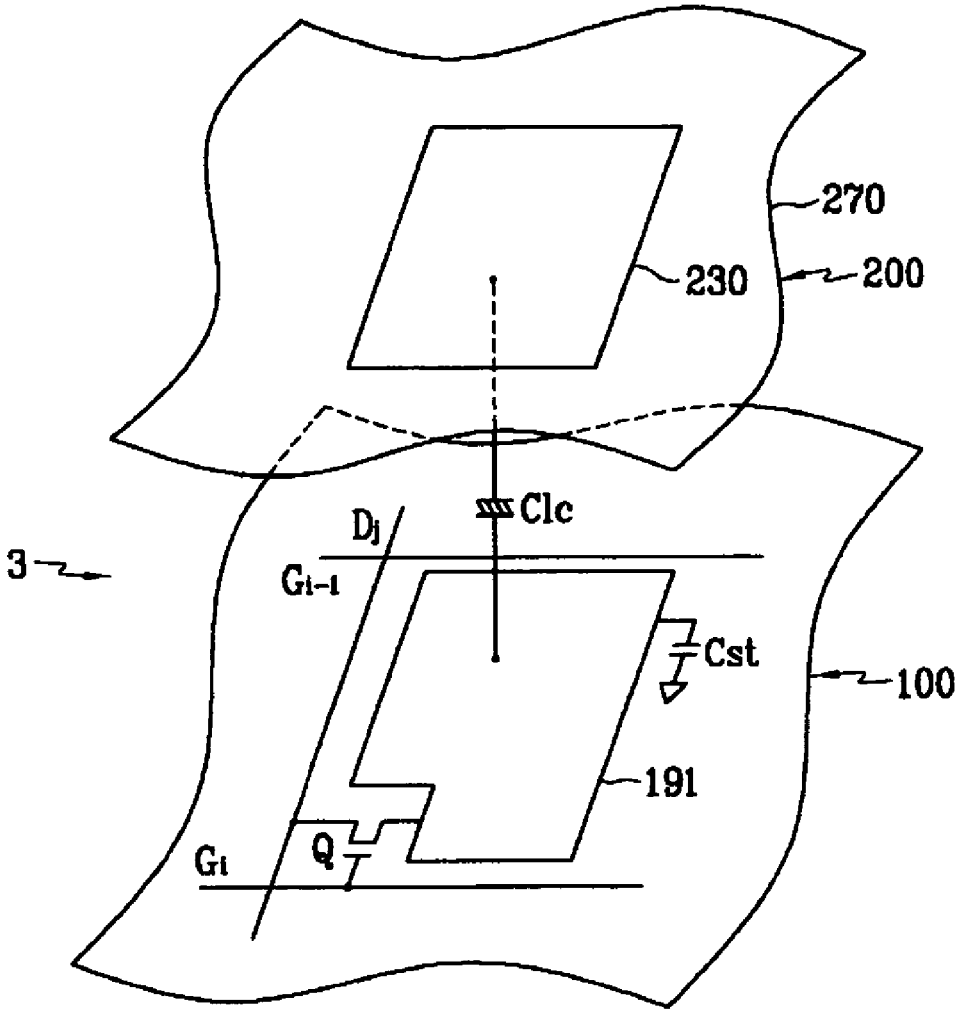
FIG. 2 is an equivalent circuit diagram of a pixel of the LCD according to the exemplary embodiment of the present invention.
Figure 3:
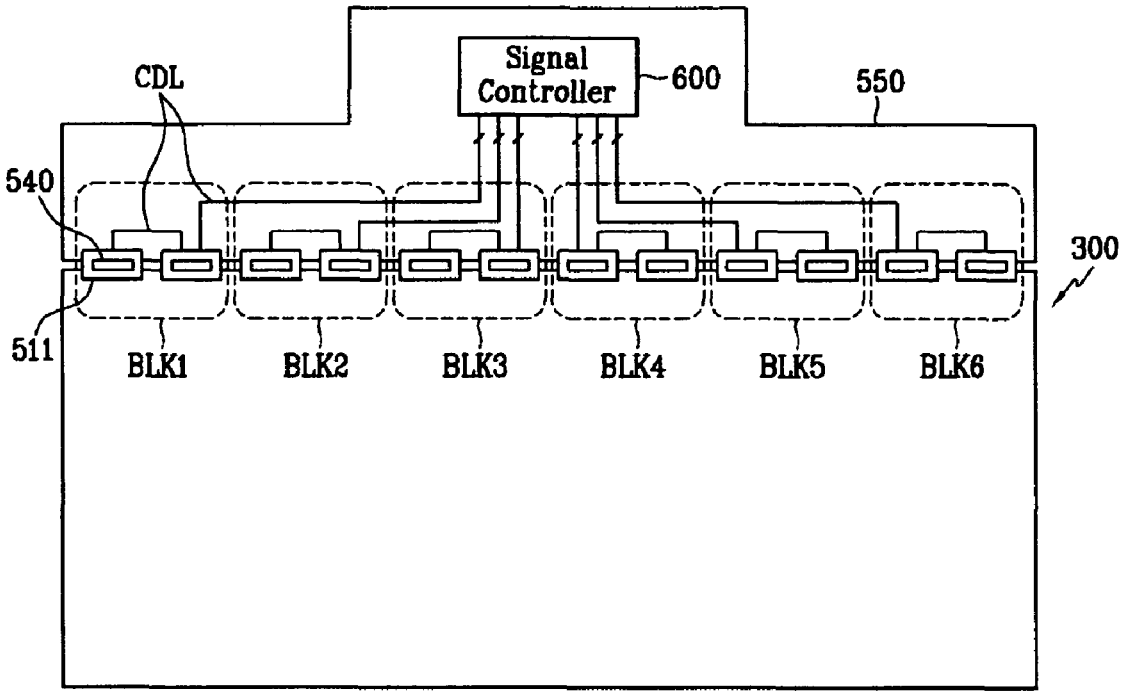
FIG. 3 is a schematic diagram showing the LCD according to the exemplary embodiment of the present invention.
Figure 4:
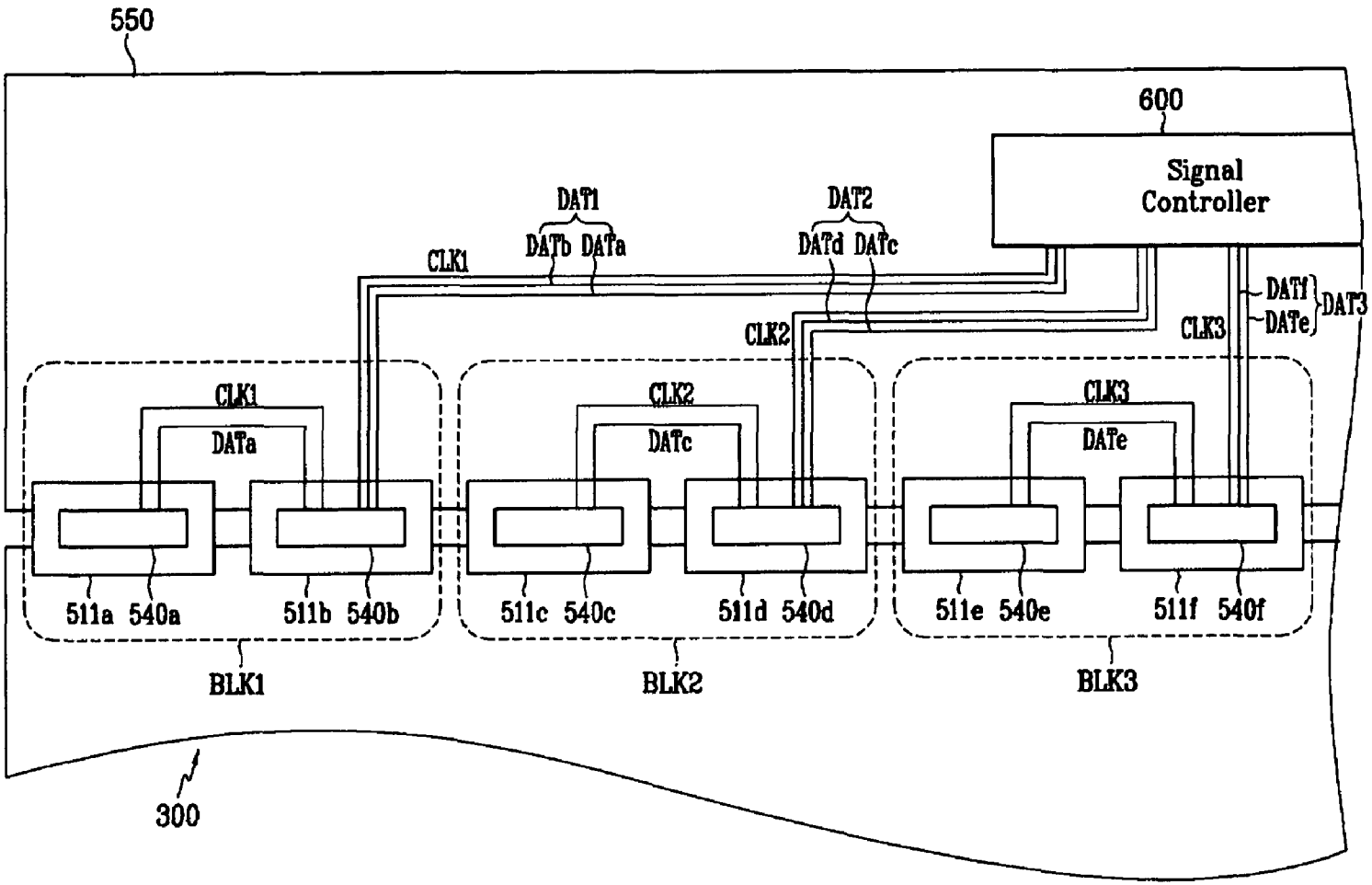
FIG. 4 is an enlarged view of a portion of the LCD in FIG. 3.
Figure 5:
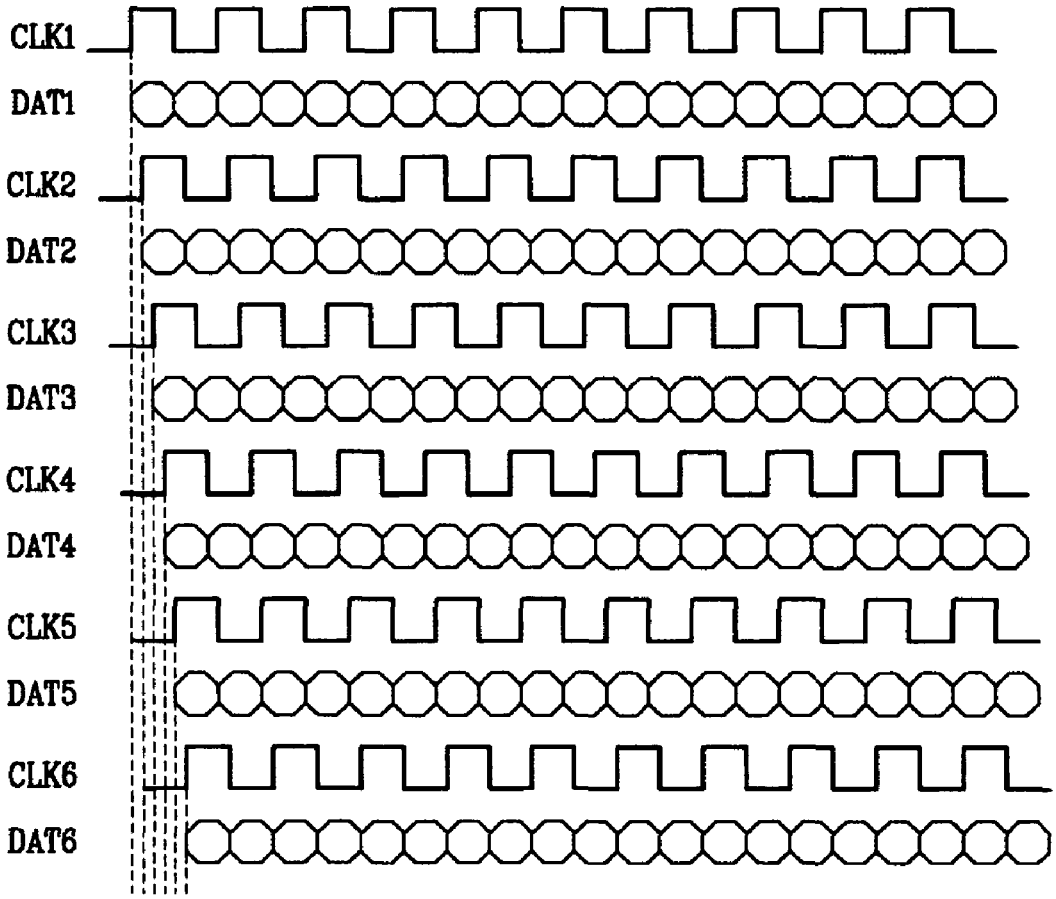
FIG. 5 is a view showing clock signals and data of the LCD according to the exemplary embodiment of the present invention.

An LCD according to an exemplary embodiment of the present invention will now be described in detail with reference to FIGS. 1 to 5. FIG. 1 is a schematic block diagram of a liquid crystal display (LCD) according an exemplary embodiment of the present invention, and FIG. 2 is an equivalent circuit diagram of a pixel of the LCD according to the exemplary embodiment of the present invention. FIG. 3 is a schematic diagram showing the LCD according to the exemplary embodiment of the present invention, FIG. 4 is an enlarged view of a portion of the LCD in FIG. 3, and FIG. 5 is a view showing clock signals and data of the LCD according to the exemplary embodiment of the present invention.

As shown in FIG. 1, the LCD according to an exemplary embodiment of the present invention includes a liquid crystal panel assembly 300, a gate driver 400 and a data driver 500 connected with liquid crystal panel assembly 300, a gray voltage generator 800 connected with data driver 500, and a signal controller 600 for controlling them.

In the view of an equivalent circuit, liquid crystal panel assembly 300 includes a plurality of signal lines $G_1$-$G_n$ and $D_1$-$D_m$ and a plurality of pixels PXs connected with the signal lines and arranged substantially in a matrix form. As shown in FIG. 2, liquid crystal panel assembly 300 includes lower and upper panels 100 and 200 and a liquid crystal layer 3 interposed therebetween.

Signal lines $G_1$-$G_n$ and $D_1$-$D_m$ include the plurality of gate lines $G_1$-$G_n$ for transferring gate signals (also called scanning signals) and the plurality of data lines $D_1$-$D_m$ for transferring data signals. Gate lines $G_1$-$G_n$ extend substantially in a row direction and almost parallel with each other, and data lines $D_1$-$D_m$ extend substantially in a column direction and also almost parallel with each other.

Each pixel PX, for example the pixel PX connected with the i-th (i=1, 2, . . . , n) gate line $G_i$ and the j-th (j=1, 2, . . . , m) data line Dj, includes a switching element Q connected with the signal line $G_i$ and $D_j$, a liquid crystal capacitor Clc, and a storage capacitor Cst connected thereto. The storage capacitor Cst can be omitted as necessary.

Switching element Q is a three-terminal element such as a thin film transistor provided in the lower panel 100. A control terminal is connected with gate line $G_1$, an input terminal is connected with data line $D_j$, and an output terminal is connected with liquid crystal capacitor Clc and storage capacitor Cst.

Liquid crystal capacitor Clc includes a pixel electrode 191 of lower panel 100 and common electrode 270 of upper panel 200 as its two terminals while liquid crystal layer 3 between the two electrodes serves as the dielectric material. Pixel electrode 191 is connected with switching element Q, and common electrode 270 is formed on the entire surface of the upper panel 200 to receive the common voltage Vcom. Unlike the structure as shown in FIG. 2, the common electrode 270 can be provided on the lower panel 100, and in this case, at least one of the two electrodes 191 and 270 can have a linear or bar shape.

Storage capacitor Cst offers auxiliary capacitance in parallel with liquid crystal capacitor Clc, its electrodes being supplied by another (separate) signal line (not shown) provided on the lower panel 100 and the overlap of pixel electrode 191 with an insulator interposed therebetween. Storage capacitor Cst can be formed by pixel electrode 191 overlapping an immediate upper previous gate line but separated therefrom by an insulator (not shown).

In order to implement color display, each pixel PX specifically displays one of the primary colors (spatial division) or pixels PXs alternately display the primary colors over time (temporal division), so that a desired color can be recognized by the spatial and temporal sum of the primary colors. The primary colors can be, for example, the three primary colors of red, green, and blue. FIG. 2 shows one example of the spatial division in which each pixel PX includes a color filter 230 that displays one of the primary colors at a region of the upper panel 200 corresponding to the pixel electrode 191. Different from the color filter 230 as shown in FIG. 2, a color filter can also be formed above or below the pixel electrode 191 of the lower panel 100. At least one polarizer (not shown) for polarizing light is attached on an outer surface of liquid crystal panel assembly 300.

Referring to FIGS. 1 and 3, gray voltage generator 800 is mounted on a printed circuit board (PCB) 550 and generates two pairs of gray voltages (or a set of reference gray voltages) related to transmittance of the pixels PXs. One pair of gray voltages have a positive value with respect to the common voltage Vcom and the other pair of gray voltages have a negative value with respect to the common voltage Vcom.

Gate driver 400 is connected with gate lines $G_1$-$G_n$ of liquid crystal panel assembly 300, and applies gate signals including a combination of a gate-on voltage Von and a gate-off voltage Voff to gate lines $G_1$-$G_n$.

Data driver 500 is connected with data lines $D_1$-$D_m$ of liquid crystal panel assembly 300, receives gray voltages from gray voltage generator 800, and selects the gray voltages and applies them as data signals to data lines $D_1$-$D_m$. If gray voltage generator 800 provides only the predetermined number of reference gray voltages rather than all the voltages with respect to all gray levels, data driver 500 divides the reference gray voltages to generate gray voltages with respect to all gray levels and selects data signals from them.

Data driver 500 includes a plurality of data driver ICs 540. Data driver ICs 540 are mounted on flexible printed circuit films 511 and are connected with signal controller 600 in a point-to-point manner to receive corresponding image data DAT1-DAT6. Based on signal controller 600, six data driver ICs 540 are arranged at the left side of signal controller 600 and another six data driver ICs 540 are arranged at the right side of signal controller 600, having a horizontally symmetrical structure.

A pair of data driver ICs 540 form a single group, so all six groups BLK1-BLK6 are disposed. The six groups BLK1-BLK6 receive image data DAT1-DAT6 and clock signals CLK1-CLK6 from signal controller 600 through signal lines CDLs, respectively, and are electrically separated.

Specifically, regarding the left side data driver IC groups BLK1-BLK3 as shown in FIG. 4, the first data driver IC group BLK1 receives the clock signal CLK1 and the data DAT1, the second data driver IC group BLK2 receives the clock signal CLK2 and the data DAT2, and the third data driver IC group BLK3 receives the clock signal CLK3 and the data DAT3 through signal lines CDLs. Respective data driver ICs 540*a*-540*f* belonging to the respective data driver IC groups BLK1-BLK3 share the clock signals CLK1-CLK3 and separately receive only the data DAT1-DAT3. That is, for example, the two data driver ICs 540*a* and 540*b* belonging to the first data driver IC group BLK1 share the clock signal CLK1, and data driver IC 540*a* receives data DATa and data driver IC 540*b* receives data DATb. Signal controller 600 controls the gate driver 400 and data driver 500.

The operation of the LCD will be described in detail as follows. Signal controller 600 receives input image signals R, G, and B and input control signals for controlling displaying of the input image signals from an external graphics controller (not shown). The input control signals may include, for example, a vertical synchronization signal Vsync, a horizontal synchronization signal Hsync, a main clock signal MCLK, or a digital input and output signal DIO, etc.

Signal controller 600 appropriately processes the input image signals R, G, and B according to operational conditions of liquid crystal panel assembly 300 based on the input control signals, generates a gate control signal CONT1 and a data control signal CONT2, and transmits the gate control signal CONT1 to the gate driver 400 and the data control signal CONT2 and the processed image signal DAT to data driver 500.

The processed image signal DAT is divided into image signals DAT1-DAT6, which are then inputted to data driver IC groups BLK1-BLK6, respectively. In this case, because respective image signals DAT1-DAT6 are transferred to each data driver ICs 540 in the point-to-point manner as mentioned above, a carry signal for shifting the data DAT1-DAT6 is not necessary. For example, data is not first filled in data driver IC 540*b* of the first data driver IC group BLK1 and then is applied to the next data driver IC 540*a*, but data DATa and DATb are generated and transmitted to be input to the respective data driver ICs 540 from the beginning.

In addition, as shown in FIG. 5, signal controller 600 makes each phase of the clock signals CLK1-CLK6 input to data driver IC groups BLK1-BLK6 different to thereby reduce the harmonic component of EMI compared with clock signals having the same phase. The phase difference of adjacent clock signals is preferably within a range of 30° or less, and the greatest phase difference between two clock signals of CLK1 to CLK6 is within a range of less than 180°.

The gate control signal CONT1 includes a scanning start signal STV for indicating a start of scanning, and at least one clock signal for controlling an output period of the gate-on voltage Von. The gate control signal CONT1 may additionally include an output enable signal OE for limiting duration of the gate-on voltage Von.

The data control signal CONT2 includes a horizontal synchronization start signal STH that informs of a start of transmission of image data with respect to one row of pixels PXs, a load signal LOAD that instructs applying of data signals to data lines $D_1$-$D_m$, and the data clock signals CLK1-CLK6. The data control signal CONT2 may additionally include an inversion signal RVS for inverting polarity of a voltage of a data signal with respect to the common voltage Vcom (which is called 'polarity of a data signal').

According to the data control signal CONT2 from signal controller 600, data driver ICs 540 receive the digital image signals DAT1-DAT6 with respect to one row of pixels PXs, selects gray voltages corresponding to each of the digital image signals DAT1-DAT6 to convert the digital image signals DAT1-DAT6 into analog data signals, and applies the analog data signals to the corresponding data lines $D_1$-$D_m$. Data driver IC groups BLK1-BLK5, which have received the clock signals CLK1-CLK5, do not output analog data signals until data driver IC group BLK6 that receives the clock signal CLK6 with the latest phase receives the data DAT6, so that all data driver ICs 540 can simultaneously output the analog data signals.

The gate driver 400 applies the gate-on voltages Von to gate lines $G_1$-$G_n$ according to the gate control signal CONT1 from signal controller 600, to turn on switching elements Q connected with gate lines $G_1$-$G_n$. Then, data signals that have been applied to data lines $D_1$-$D_m$ are applied to the corresponding pixels PXs through the switching elements Q that have been turned on.

The difference between a voltage of the data signals applied to the pixels PXs and the common voltage Vcom appears as a charge voltage of liquid crystal capacitor Clc, namely, as a pixel voltage. Arrangement of liquid crystal molecules is changed according to the size of the pixel voltage, and polarization of light that transmits through liquid crystal layer 3 is changed accordingly. The change in the polarization appears as a change in transmittance of light by a polarizer attached on the display panel assembly 300.

This process is repeatedly performed by units of one horizontal period (namely, '1H' which is equivalent to one period of the horizontal synchronization signal Hsync), whereby the gate-on voltage Von can be sequentially applied to all gate lines $G_1$-$G_n$ to thus apply the data signals to all the pixels PXs to thereby display an image of one frame.

When one frame is finished, the next frame is started and a state of the inversion signal RVS applied to data driver 500 is controlled ('frame inversion') so that polarity of the data signals applied to each pixel PX can be the opposite to the polarity of the data signal of the previous frame. In this case, even in one frame, the polarity of a data signal flowing through one data line can be changed according to characteristics of the inversion signal RVS (e.g., row inversion, dot inversion), or the polarity of a data signals applied to one row of pixels can be different from each other (e.g., column inversion, dot inversion).

As described above, because data driver IC groups BLK1-BLK6 receive the separate clock signals CLK1-CLK6, a signal delay can be reduced, and in addition, because the phases of the clock signals are different, the harmonic component can be reduced compared with the related art in which the clock signals have no phase difference, and thus the EMI can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the invention.

What is claimed is:

1. A display device in which a plurality of pixels are arranged in a matrix, comprising:

data lines connected with the pixels;

a signal controller for processing image data received from outside, and generating a plurality of control signals and a plurality of clock signals;

a gray voltage generator for generating a plurality of gray voltages; and a data driver comprising a plurality of data driver ICs for selecting gray voltages corresponding to image data received from the signal controller among the plurality of gray voltages and applying corresponding data voltages to the data lines, wherein the data driver comprises at least four data driver IC groups, and each data driver IC group receives a separate clock signal and comprises at least two data driver ICs connected in series with each other.

2. The device of claim 1, wherein at least four data IC groups receive the clock signals each with a different phase, respectively.

3. The device of claim 2, wherein a phase difference between the adjacent clock signals is smaller than 30°, and the greatest phase difference between two clock signals is smaller than 180°.

4. The device of claim 3, wherein the signal controller and the data driver ICs are connected in a point-to-point manner.

5. The device of claim 4, wherein the data driver IC groups are positioned symmetrically centering on the signal controller.

6. The device of claim 1, wherein the plurality of clock signals comprise first to sixth signals inputted to first to sixth data driver IC groups.

7. The device of claim 6, wherein the first to sixth signals sequentially have a phase difference smaller than 30°.

8. The device of claim 7, wherein the first and sixth signals have a phase difference smaller than 180°.

9. The device of claim 8, wherein the first to sixth data driver IC groups apply the data voltages to data lines at the same time.

10. The device of claim 9, wherein the first to third data driver IC groups are positioned at the left side of the signal controller, and the fourth to sixth data driver IC groups are positioned at the right side of the signal controller.

11. The device of claim 10, wherein the signal controller and the data driver ICs are connected in the point-to-point manner.

* * * * *